United States Patent [19]

Allen, Jr.

[11] Patent Number: 4,774,774

[45] Date of Patent: Oct. 4, 1988

[54] DISC SPRING SOLE STRUCTURE

[76] Inventor: Freddie T. Allen, Jr., 343 Shades Crest Rd. South, Birmingham, Ala. 35226

[21] Appl. No.: 76,231

[22] Filed: Apr. 13, 1987

Related U.S. Application Data

[63] Continuation-in-part of Ser. No. 865,672, May 22, 1986, abandoned.

[51] Int. Cl.[4] ..... A43B 13/18; A43B 13/20

[52] U.S. Cl. ..... 36/28; 36/29

[58] Field of Search ..... 36/28, 29, 30 R, 43, 36/102, 7.8, 27

[56] References Cited

U.S. PATENT DOCUMENTS

| | | | |
|---|---|---|---|
| 2,437,227 | 3/1948 | Hall | 36/28 |
| 2,721,400 | 10/1955 | Israel | 36/28 |
| 4,267,648 | 5/1981 | Weisz | 36/38 |
| 4,297,796 | 11/1981 | Stirtz et al. | 36/28 |
| 4,340,626 | 7/1982 | Rudy | 36/29 |
| 4,342,158 | 8/1982 | McMahon | 36/28 |
| 4,364,186 | 12/1982 | Fukuoka | 36/29 |
| 4,485,568 | 12/1984 | Landi et al. | 36/28 |
| 4,494,322 | 1/1985 | Klagmann | 36/28 |
| 4,506,460 | 3/1985 | Rudy | 36/28 |
| 4,521,979 | 6/1985 | Blaser | 36/29 |
| 4,535,553 | 8/1985 | Derderian et al. | 36/28 |
| 4,536,974 | 8/1985 | Cohen | 36/28 |
| 4,593,482 | 6/1986 | Mayer | 36/28 |
| 4,670,995 | 6/1987 | Huang | 36/29 |
| 9,534,121 | 8/1985 | Autry | 36/43 |

FOREIGN PATENT DOCUMENTS

| | | | |
|---|---|---|---|
| 806647 | 4/1951 | Fed. Rep. of Germany | 36/29 |
| 1603646 | 11/1981 | United Kingdom | 36/29 |
| 2102669 | 2/1983 | United Kingdom | 36/43 |

*Primary Examiner*—Steven N. Meyers

[57] ABSTRACT

A midsole for athletic shoes that stores energy. The "honey comb" midsole absorbs the body weight of the athletic and converts the force into a spring-back energy that reduces the workload of leg muscles therefore a reduction of leg muscle fatigue results.

4 Claims, 3 Drawing Sheets

DISC SPRING SOLE STRUCTURE

This application is a continuation in part of application Ser. No. 865,672 filed May 22, 1986, now abandoned.

BACKGROUND OF THE INVENTION

This invention relates to athletic shoe soles. It is a sole design to reduce leg muscle fatigue that results from athletic activity. Hereto, conventional atheletic shoes were primarily designed to provide an adequate shock absorbent cushion for feet and ankle protection, but these conventional soles lack a resilient platform that returns significant energy to the base of the foot. The inventive sole is an improvement in this field of invention because it performs the dual function of shock absorber and source of energy.

The inventive sole structure was filed as the "Verti-Flex Midsole" under the Disclosure Document Program on Mar. 19, 1986, Disclosure Document No. 146,411.

Other sole structures have been disclosed for both athletic and dress shoes in the patent literature. For example, U.S. Pat. No. 2,437,227 discloses the use of coil springs within a cushioning midsole layer and U.S. Pat. No. 4,535,553 discloses a shock absorbing sole layer of a plurality of transversely and longitudinally spaced discrete shockings projections.

SUMMARY OF THE INVENTION

The inventive sole structure is a platform comprising a plurality of vertically stacked disc-springs which in vertical cross-section appear as six-sided cells. The cells span the width and length of the sole.

The vertical stacks of six-sided cells are interconnected by a horizontally parallel framework. The horizontally parallel framework is so structured as to form a series of cells between each adjacent vertical stack of disc-spring cells. The open cells also appear six-sided in vertical cross-section.

The disc-springs and horizontally parallel framework form a honeycomb framework that spans the width and length of the midsole. This honeycomb framework has the characteristics of applying energy to the base of the foot upon release after load compression.

The material used in the sole is called Hytrel plastic, a product of the Dupont Corporation. Hytrel plastic is a solid, flexible, compressible material that stores energy: its ability to store energy is the essence of the invention; whereby it provides the shock absorbent/-spring-back action that is applied to the base of the foot from the sole.

As the athlete's leg muscles contract and expand during running or jumping movements, the work load of moving the body weight is absorbed into the disc-spring structure of the sole. The disc-spring cells, being air-filled, compress as they store energy and absorb the shock of the impact. The energy is converted into a spring-back action that is exerted against the base of the foot. With the workload of lifting the foot reduced, less energy-out of the leg muscles is required.

Thus, the verti-flex midsole acting in co-operation with the athlete's leg muscles reduces muscle fatigue by reducing the workload of physical activity.

DESCRIPTION OF THE PREFERRED EMBODIMENTS

Figure 1:
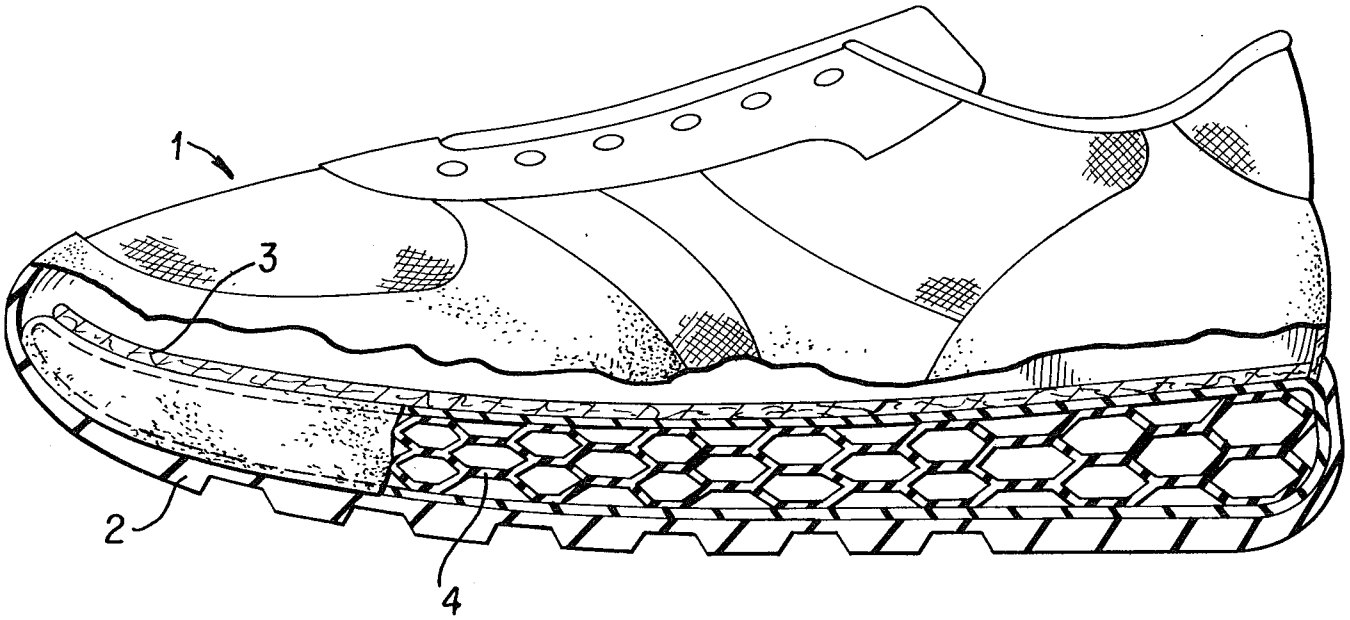
FIG. 1 is a cut-away side view of an athletic shoe incorporating the inventive sole structure in vertical cross-section in the midsole of an athletic shoe.
Figure 2:
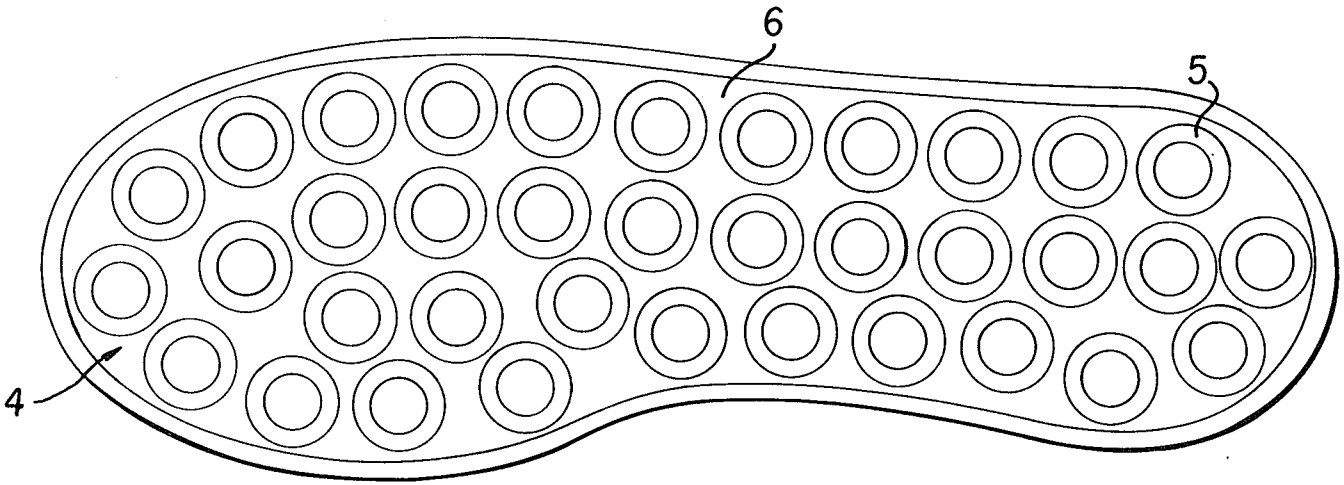
FIG. 2 is a cut-away top view of an athletic shoe incorporating the inventive sole structure in the midsole of an athletic shoe.

FIGS. 1–2 show the inventive sole structure in the form of a midsole.

A conventional athletic shoe 1 is shown in FIG. 1 having a conventional outsole 2 and insole 3. The inventive sole structure is provided as a midsole 4, between insole 3 and outsole 2.

The honeycomb framework of the sole structure as shown in FIG. 1 comprises a plurality of vertically stacked disc-springs 5 which in vertical cross-section appear as six-sided cells. The cells are so structured as to form two acute angles contraposed toward the center of the six-sided cell on its horizontal plane and four obtuse angles contraposed toward the center of the six-sided cell on its vertical plane. The cells are interconnected by a horizontally parallel framework 6, so structured as to form a series of open cells 7 between each adjacent vertical stack of disc-springs 5. The open cells 7 also appear six-sided in vertical cross-section as shown in FIG. 1.

FIG. 2 shows the structure of the disc-spring midsole as viewed from above.

Figure 3:
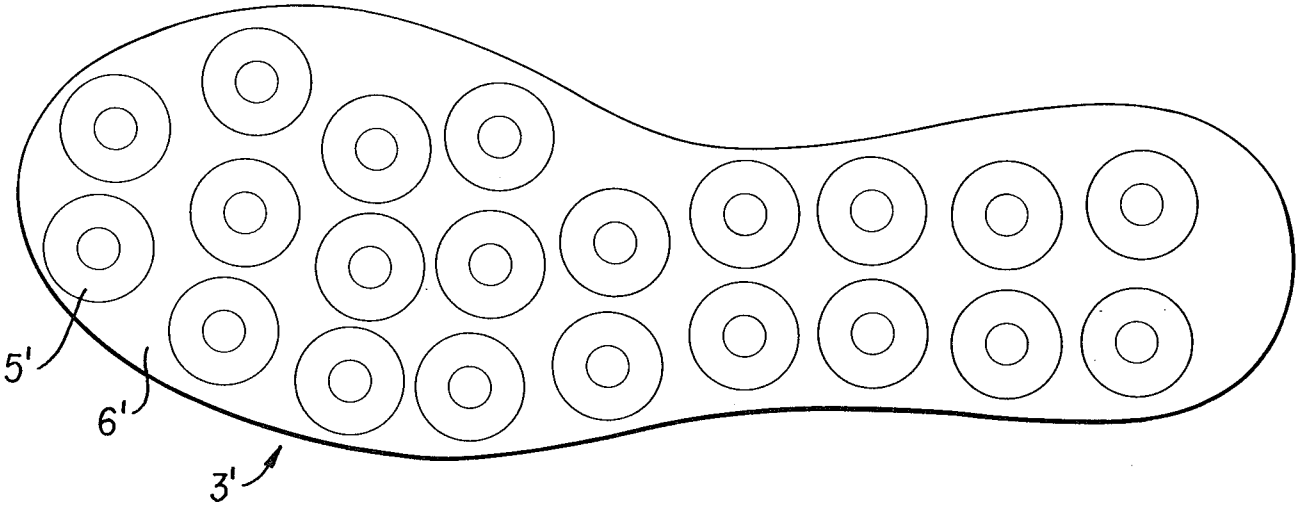
FIG. 3 is a top view of the inventive sole structure in the form of an insole.
Figure 4:
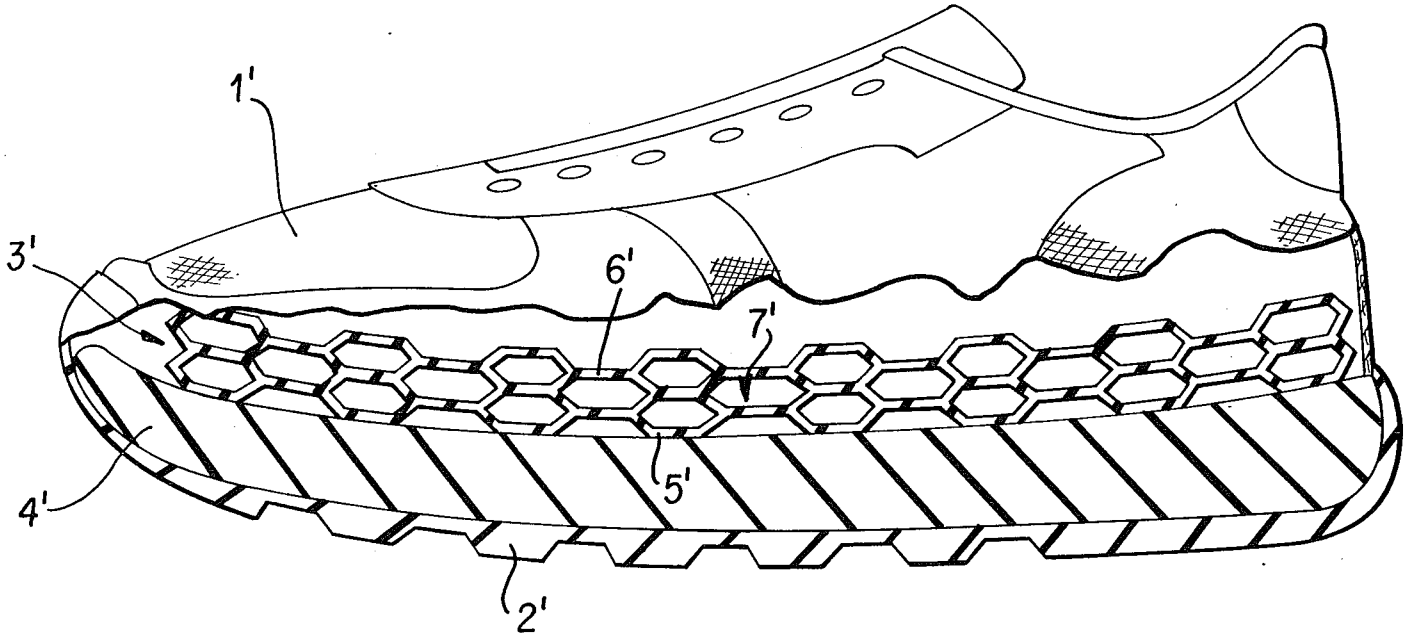
FIG. 4 is a cut-away side view of an athletic shoe having the inventive insole of FIG. 3 applied therein.

FIGS. 3 and 4 show the disc-spring sole structure in the form of an insole.

A conventional athletic shoe 1' is shown in FIG. 4, having a conventional outsole 2' and midsole 4'. The inventive sole structure is provided as an insole 3', placed conventionally within the athletic shoe 1' and extending the entire length and width of the shoe.

The honeycomb framework of the insole comprises a plurality of vertically stacked disc-springs 5' which in vertical cross-section appear as six-sided cells. The cells are so structured as to form two acute angles contraposed toward the center of the six-sided cell on its horizontal plane and four obtuse angles contraposed toward the center of the six-sided cell on its vertical plane. The cells are interconnected by a horizontally parallel framework 6', so structured as to form a series of open cells 7' between each adjacent vertical stack of disc-springs 5'. The open cells 7' also appear six-sided in vertical cross-section as shown in FIG. 4.

FIG. 3 shows the insole 3' of FIG. 4 viewed from above.

The disc-spring cells 5, 5' in both the inventive midsole and insole have air trapped within them, giving them the characteristics of an air -filled chamber.

The invention is primarily designed for a running or jogging shoe but can be used for basketball, football and tennis shoes or any athletic activity shoe.

While the above description contains specifics, these should not be constructed as limitations on the scope of the inveniton, but rather as an exemplification of one preferred embodiment thereof. Many other variations are possible, for example, the inventive sole structure can be encapsulated in polyrethene foam, EVA foam, or any state of the art material used in athletic shoes.

What is claimed is:

1. A midsole for use in a sole for foot wear comprising a plurality of resilient, air-filled, vertically stacked cells; said cells being six-sided when viewed in vertical cross-section; wherein said six-sided cells are so structured;

as to form two acute angles contraposed toward the center of the six-sided cell on its horizontal plane and four obtuse angles contraposed toward the center of the six-sided cell on its vertical plane; wherein said cells are arranged in adjacent vertical stacks; wherein said adjacent vertical stacks of six-sided cells are interconnected by horizontally parallel framework of the midsole's structure;

and said interconnecting horizontally parallel framework form a series of resilient six-sided open cells between each adjacent vertical stack;

thus forming a resilient honeymomb framework that spans the width and length of the midsole; whereby said honeycomb framework has the characteristic of applying energy to the base of the foot upon release after load compression.

2. A midsole in accordance with claim 1 wherein said plurality of resilient cells are vertically stacked in series;

and said plurality of vertical stacks span the width and length of the said midsole.

3. An insole for use inside of a shoe comprising a plurality of resilient, air-filled, vertically stacked cells; said cells being six-sided when viewed in vertical cross-section; wherein said six-sided cells are so structured;

as to form two acute angles contraposed toward the center of the six-sided cell on its horizontal plane and four obtuse angles contraposed toward the center of the six-sided cell on its vertical plane;

wherein said cells are arranged in adjacent vertical stacks; wherein said adjacent vertical stacks of six-sided cells are interconnected by horizontally parallel framework of the insole's structure;

and said interconnecting horizontally parallel framework form a series of resilient six-sided open cells between each adjacent vertical stack;

thus forming a resilient honeycomb framework that spans the width and length of the insole; whereby said honeycomb framework has the characteristic of applying energy to the base of the foot upon release after load compression.

4. An insole in accordance with claim 3 wherein said plurality of resilient cells are vertically stacked in series;

and said plurality of vertical stacks span the width and length of the said insole.

* * * * *